US008390457B2

(12) United States Patent
Stefanelli

(10) Patent No.: US 8,390,457 B2
(45) Date of Patent: Mar. 5, 2013

(54) APPARATUS FOR CONTAINING AND TRANSPORTING PRECIOUS ITEMS

(76) Inventor: Paolo Stefanelli, Milan (IT)

( * ) Notice: Subject to any disclaimer, the term of this patent is extended or adjusted under 35 U.S.C. 154(b) by 327 days.

(21) Appl. No.: 12/668,342

(22) PCT Filed: Jul. 23, 2007

(86) PCT No.: PCT/IT2007/000515
§ 371 (c)(1),
(2), (4) Date: Jan. 15, 2010

(87) PCT Pub. No.: WO2009/013765
PCT Pub. Date: Jan. 29, 2009

(65) Prior Publication Data
US 2010/0194570 A1 Aug. 5, 2010

(51) Int. Cl.
*G08B 13/14* (2006.01)

(52) U.S. Cl. ..... 340/572.1; 340/568.1; 340/572.8; 340/5.92; 340/5.2

(58) Field of Classification Search ..... 340/572.1, 340/568.1, 572.8, 5.92, 5.2, 5.8, 686.6
See application file for complete search history.

(56) References Cited

U.S. PATENT DOCUMENTS

| | | | | |
|---|---|---|---|---|
| 4,682,691 | A | 7/1987 | Spiering | |
| 7,262,698 | B1 * | 8/2007 | Frederick et al. | 340/545.6 |
| 2002/0145520 | A1 * | 10/2002 | Maloney | 340/568.1 |
| 2003/0117281 | A1 * | 6/2003 | Sriharto et al. | 340/568.1 |
| 2003/0122673 | A1 | 7/2003 | Anderson | |
| 2005/0040934 | A1 * | 2/2005 | Shanton | 340/5.92 |
| 2005/0093702 | A1 * | 5/2005 | Twitchell, Jr. | 340/572.8 |
| 2007/0057795 | A1 * | 3/2007 | Kawai et al. | 340/572.7 |
| 2007/0164857 | A1 * | 7/2007 | Odenwald et al. | 340/539.22 |
| 2008/0094214 | A1 * | 4/2008 | Azevedo et al. | 340/568.1 |

* cited by examiner

*Primary Examiner* — Hoi Lau
(74) *Attorney, Agent, or Firm* — Pearne & Gordon LLP

(57) ABSTRACT

An apparatus for containing and transporting precious items comprises at least one holding structure (2) adapted to contain at least one precious item (200), at least one antenna (3) adapted to detect the presence of an electronic identification device (201) associated with the precious item (200), in order to determine the contents of the holding structure (2) and send a signal (S1) representative of same at least on occurrence of a predetermined event, storing means (4) physically associated with the holding structure (2) and operatively associated with the antenna (3) for receiving the signal sent therefrom on occurrence of a first event and store the contents of the holding structure (2) on occurrence of the first event. A processing unit (5) can be connected to the storing means (4) and the antenna (3) to compare the contents of the storing means (4) with a signal (S2) sent by the antenna (3) on occurrence of a second event subsequent in time to the first one.

10 Claims, 3 Drawing Sheets

FIG 4
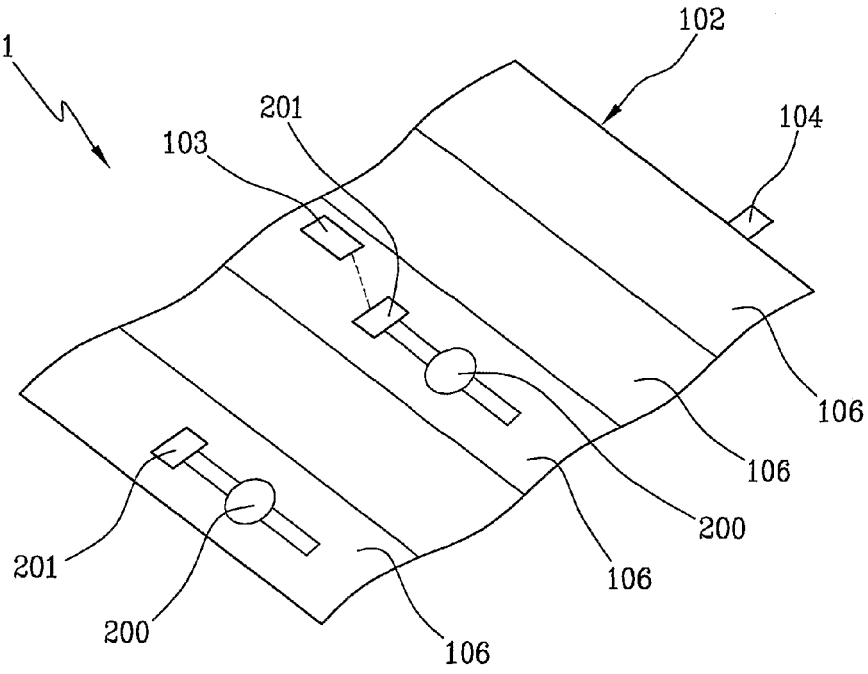
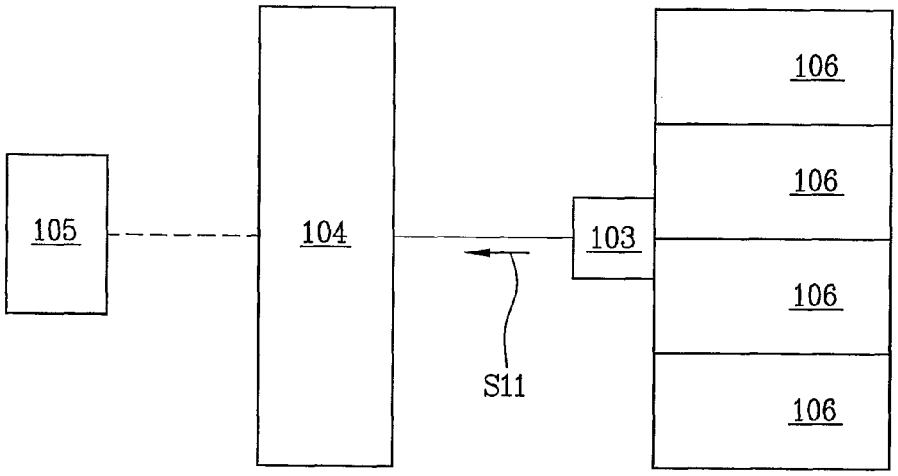
FIG 5

APPARATUS FOR CONTAINING AND TRANSPORTING PRECIOUS ITEMS

The present invention relates to an apparatus for containing and transporting precious items.

As known, data plates are usually utilised on goods offered for sale, and in particular on jewelry and horology items, which data plates have a dual purpose: reproducing the brand name, model, price and possible other description data of the goods with which said plates are associated, and preventing said goods from being stolen or in any case removed in an illegal and uncontrolled manner from the area where they must stay.

This dual purpose is obtained by virtue of a circuit housed within the plate which generally comprises a memory, in which a code is contained for identification of the product, as well as a transmission module for generating a signal incorporating the identification code, and an antenna for transmission of said signal.

As far as the item and related plate are in a predetermined, suitably monitored area, such as a shop or a store, the circuit talks at a predetermined frequency to a monitoring system installed in the shop or store, so that the monitoring system has a continuous confirmation of the presence of the item in the predetermined area.

When the system does no longer detect the presence of the plate (and therefore of the item associated therewith), the shopkeeper or storekeeper is immediately informed, so that the theft or at all events the illegal removal of the precious item is signalled in due time.

If the precious item is legally moved away from the shop or store, for transport from the shop to the store or vice versa for example, either the monitoring system must be disconnected or the plate must be removed from the precious item.

However both these operations generate a loss of traceability of the precious item which therefore is not traceable any longer by the keeper, i.e. the person who is currently responsible for the item itself.

To remedy this deficiency, the item to be transferred is recorded on a suitable packing list that will follow the item itself to its new destination.

Once the item has reached its new destination, a new keeper is entrusted with said item and, based on the information contained in the packing list, he/she carries out insertion of the item into a new area monitored by a monitoring system similar to the above described one.

Clearly, the above described transport procedure is complicated and linked to correct drawing-up of the packing list, inclusive of serial number and other data concerning the precious item.

In addition, in the event of possible lost of the packing list, it is inevitably impossible to determine the amount and type of precious items being transported and transferred.

Accordingly, it is an aim of the present invention to make available an apparatus for containing and transporting precious items which enables a perfect traceability of the precious item both during transport and during storage of same.

Another aim of the present invention is to provide an apparatus for containing and transporting precious items which allows a simple and controlled transport of said precious items or valuables.

A further aim of the present invention is to make available an apparatus for containing and transporting precious items that, within the same structure, allows the exact storage area of a precious item to be known.

The foregoing and further aims are substantially achieved by an apparatus for containing and transporting precious items in accordance with one or more of the appended claims.

Further features and advantages will become more apparent from the detailed description of a preferred but not exclusive embodiment of an apparatus for containing and transporting precious items in accordance with the invention.

This description is taken with reference to the accompanying drawings given by way of non-limiting example, in which:

FIG. 4 is a diagrammatic perspective view of an alternative embodiment of the apparatus shown in FIG. 1; and FIG. 5 is a block diagram of the apparatus shown in FIG. 1.

Figure 2:
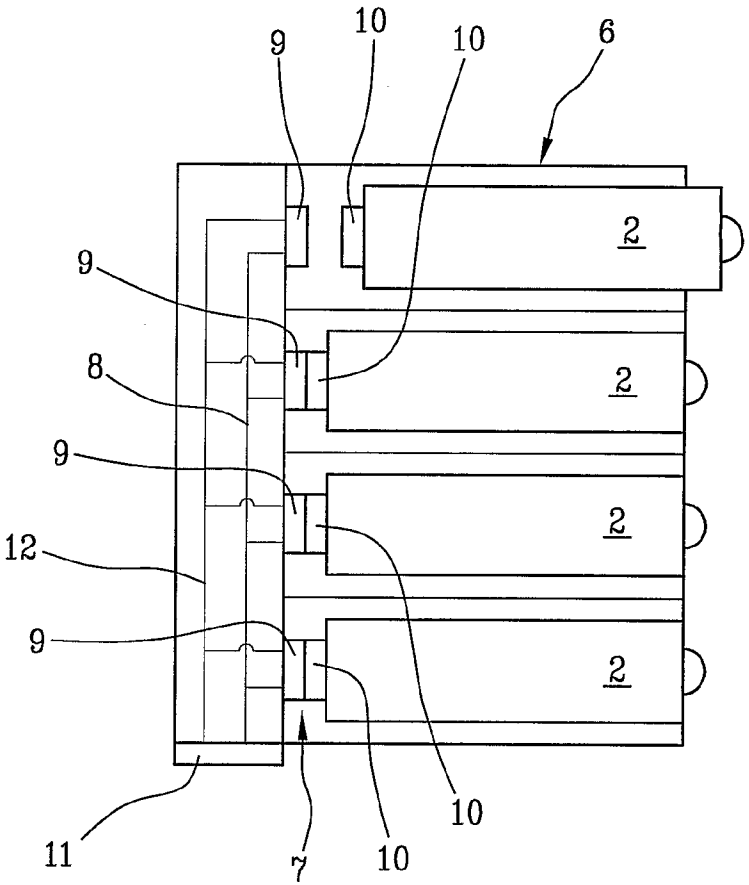
FIG. 2 is a diagrammatic side view of the apparatus seen in FIG. 1.

With reference to the drawings, an apparatus for containing and transporting precious items in accordance with the present invention has been generally identified with reference numeral 1.

Figure 1:
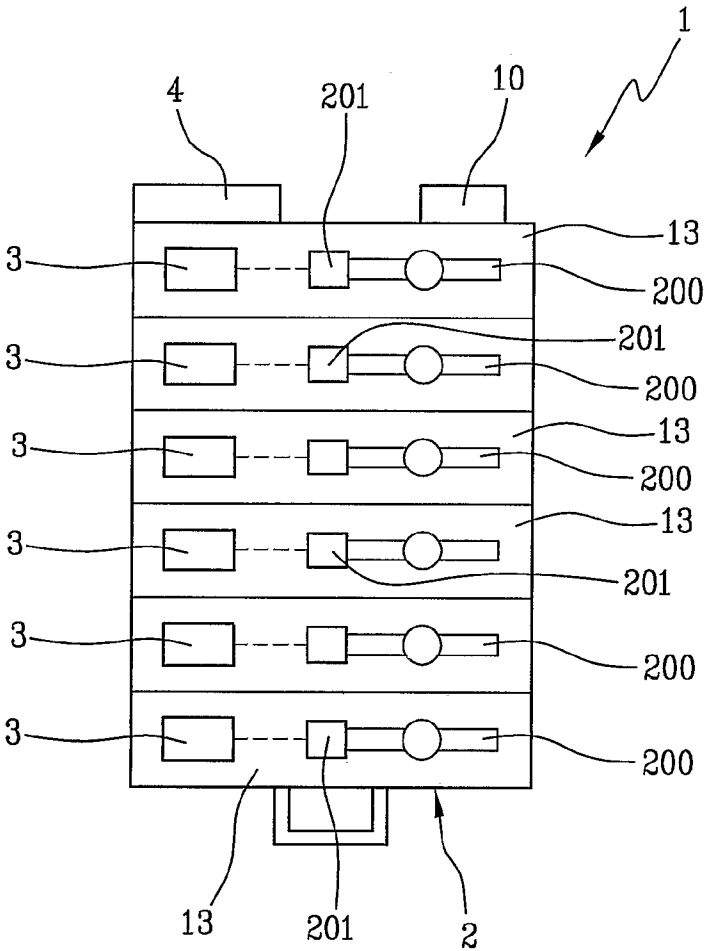
FIG. 1 is a diagrammatic top view of an apparatus for containing and transporting precious items in accordance with the present invention.

Apparatus 1 (FIGS. 1-3) comprises at least one holding structure 2 adapted to contain at least one precious item 200.

In the embodiment shown in the figures, the precious item 200 has been shown in the form of a watch, however it can be any item having a particular economic value and sizes typical of the items offered on sale in jeweler's, goldsmith's and watchmaket's shops.

Apparatus 1 comprises at least one antenna 3 adapted to detect the presence of an electronic identification device 201 associated with the precious item 200, to determine the contents of the holding structure 2 and send a signal S1 representative of same at least on occurrence of a predetermined event.

The electronic identification device 201 in the preferred embodiment is a transponder, i.e. a circuit designed to receive a request signal and generate a corresponding response signal.

In particular, the electromagnetic field generated by the request signal feeds and energises the circuit generating the response signal.

By way of example, the response circuit can be made as a TAG ISO operating at 13.56 MHz.

Preferably, the response circuit provided with a transmission module to generate the response signal.

The response circuit further comprises a memory to store an identification code ID unequivocally associated with the precious item 200. In other words, associated with the precious item 200 is an identification code ID enabling the item to be recognised even among a plurality of quite identical items.

Apparatus 1 further comprises storing means 4 physically associated with the holding structure 2 and operatively associated with the antenna 3, to receive the signal S1 sent from said antenna 3 on occurrence of a first event and store the contents of the holding structure 2 on occurrence of the first event.

Signal S1 in particular contains data transmitted by the identification device 201 associated with the precious item 200 present in the holding structure 2.

A processing unit 5 can be connected to the storing means 4 and antenna 3 to compare the contents of the storing means 4 with a signal S2 sent by the antenna on occurrence of a second event following the first one in time.

The holding structure 2 is insertable in a removable manner into a storage structure 6 (FIG. 2) which comprises enable means 7 for sending signal S2 generated by antenna 3 and reading the contents of the storing means 4.

The enable means 7 comprises an electric connection 8 for power supply to antenna 3 so as to generate the electromagnetic field feeding the transponder 201 associated with the precious item 200.

The electric connection 8 consists of a connector 9 disposed in the storage structure 6 and co-operating with a further connector 10 provided on each holding structure 2.

Coupling of the two connectors 9, 10 ensures power supply to antenna 3.

The enable means 7 further comprises a data transmitting device 11 to send data to the processing unit 5. This data transmitting device 11 can be of the wireless type as in the example shown in FIGS. 2 and 3, or it can allow a cable connection depending on location of the storage structure 6 relative to the processing unit 5 or on particular contingent requirements.

Figure 3:
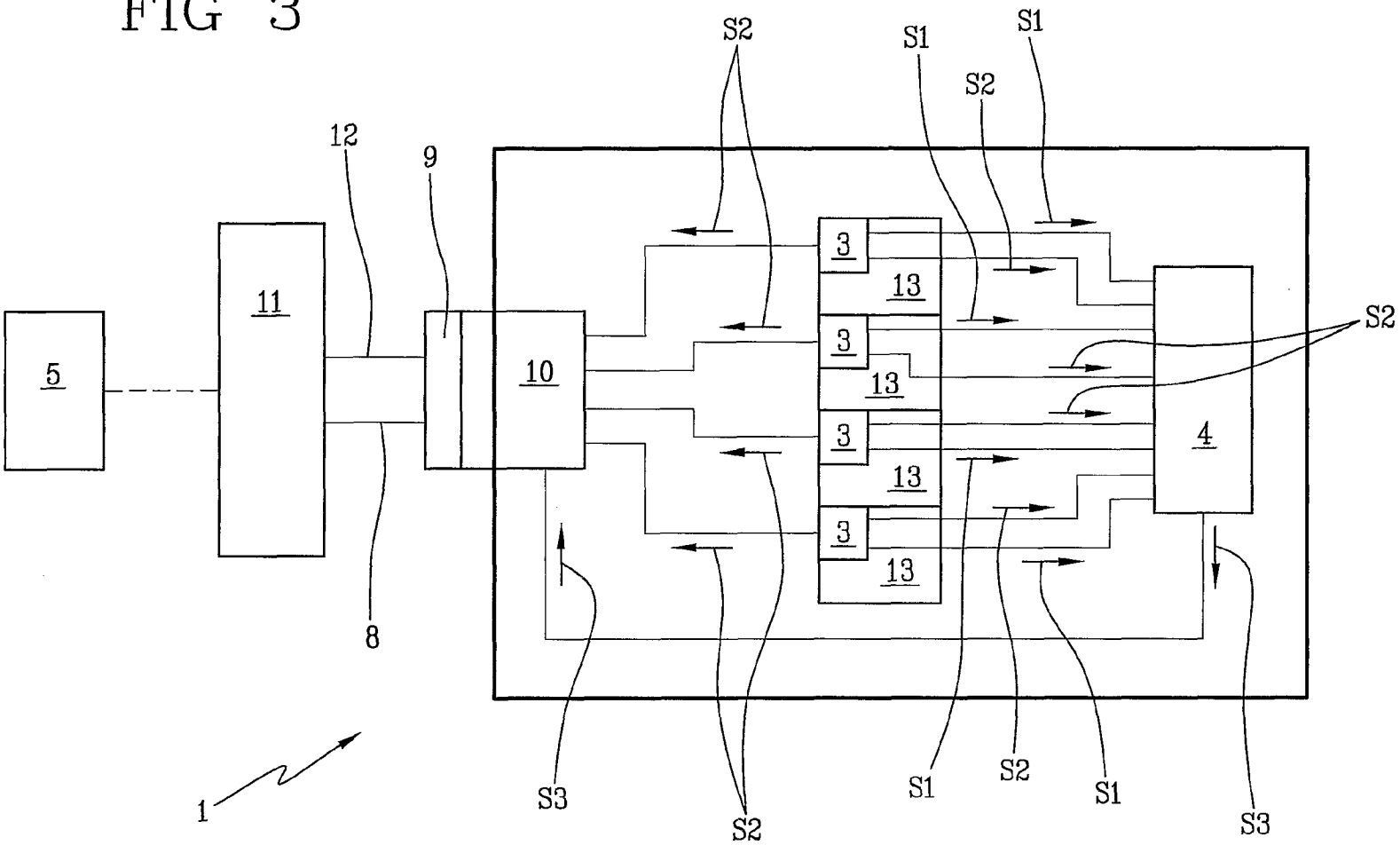
FIG. 3 is a block diagram of the apparatus in FIGS. 1 and 2.

In the preferred embodiment, the storage structure 6 is adapted to receive a plurality of holding structures 2 (FIG. 2). Each holding structure 2 is provided with a connector 10 and storing means 4 of its own and the storage structure 6 is equipped with corresponding connectors 9 for the connectors 10 of the holding structures 2.

Preferably, the storage structure 6 is provided with, suitable guides or other positioning members (not shown) for each holding structure 2 so that, when the latter is housed in the storage structure 6, connectors 9, 10 are in a condition of mutual contact.

To ensure connection and data transfer from connectors 9 of the storage structure 6 to the data transmitting device 11, the enable means 7 preferably comprises a single data transmitting line 12 connecting all connectors 9 in series or in parallel.

The holding structure 2 comprises a plurality of reserved spaces 13, each of which is adapted to contain a precious item. The reserved spaces 13 can be physically or only functionally separated from each other and in the last-mentioned case each reserved space 13 comprises retaining means (not shown) to keep the precious item to a predetermined position.

Associated with each reserved space 13 is a respective antenna 3 which therefore is designed to determine the presence or not of a precious item within the reserved space 13 pertaining to it.

In addition, each reserved space 13 is electromagnetically insulated from the others, i.e. it is shielded relative to the electromagnetic field generated by antennas 3 associated with the other reserved spaces 13, in such a manner as to avoid false readings or interferences.

In a storage structure 6 with which a plurality of holding structures 2 are associated, said holding structures are electromagnetically insulated from each other.

In use, the holding structure 2 and in particular the reserved spaces 13 thereof, are partly or fully filled with precious items 200.

Then antennas 3 are temporarily powered and, as above said, they generate respective electromagnetic fields powering the transponder 201 associated with the precious item 200 contained in each % reserved space 13 of the holding structure 2. Powering of antennas 3 is the first event referred to above.

Reading of antennas 3, i.e. determination of the presence or not of a precious item 200, is sent via said first signal S1 to the storing means 4. It is to be pointed out that, preferably, this storing means 4 is a single storing device, in particular a memory card, into which all signals S1 sent from antennas 3 of each reserved space 13 of the holding structure 2 itself converge.

At this point, antennas 3 are no longer powered and the holding structure 2 is transported where the precious items housed in the holding structure 2 have been required.

Once the holding structure 2 has reached its destination, it is inserted into the storage structure 6. A preferably full insertion of the holding structure into the storage structure 6 is the second event referred to above. In particular, this insertion gives rise to mutual connection of the two connectors 9, 10 and activation of antennas 3.

As above said, activation of antennas 3 generates an electromagnetic field feeding the transponder associated with the precious item contained in each reserved space 13 of the holding structure 2.

The response of each transponder is then detected by antennas 3 that will send the second signal S2 to connector 9 and, through the latter, to the data transmitting line 12 of the storage structure 6.

The storing means 4 sends a signal S3 representative of signal S1 previously received and stored, towards connector 10 and then towards connector 9 and the data transmitting line 12 of the storage structure 6.

Under the same situation, a copy of signal S2 is sent to the storing means 4 to be stored by the latter as a new signal representative of the contents of the holding structure 2. The second signal S2 can also be sent to the storing means 4 alone and, therefrom directed to connector 10.

Signals S2 and S3 representative of the contents of the holding structure at the instant of the first event and second event are then transmitted by the data transmitting device 11 to the processing unit 5. The latter carries out a comparison between the two signals to determine possible differences and go back to the exact missing precious item.

An auxiliary comparison can be carried out with an electronic transport document associated with the holding structure 2 to check whether all the provided operations have been correctly performed.

In the preferred embodiment described above and depicted in FIGS. 1 to 3, the holding structure 2 is a drawer which is insertable into and removable from the storage structure 6. The latter can be a chest of drawers, a piece of furniture, a safe, a display case or any other structure adapted to receive a drawer in engagement.

It will be recognised that a plurality of storage structures 6 can be connected to the processing unit 5, irrespective of the fact that they are equal to or different from each other.

In an alternative embodiment (FIGS. 4 and 5), a holding structure 102 is a foldable structure, preferably a structure adapted to be rolled up.

In particular, in this alternative embodiment, the holding structure 102 is a fabric cloth of the type commonly used in watchmaker's, jeweler's or goldsmith's shops to stow and keep valuables.

In this embodiment, the apparatus for containing and transporting precious items comprises the holding structure 102 adapted to contain at least the precious item. 200 and at least one antenna 103 suitable for detecting the presence of the electronic identification device 201 associated with the precious item 200, to determine the contents of the holding structure 102 and send a signal S11 representative of same.

Apparatus 1 further comprises data transferring means 104 physically associated with the holding structure 102 and operatively associated with antenna 103 for receiving signal S11 sent by the antenna 103.

Apparatus 1 further comprises a processing unit 105 (that can be coincident with the processing unit 5 of the first embodiment) which can be connected to the data transferring means 104, for comparing the contents of the holding structure 102 with a previously established contents of the holding structure 102.

In this embodiment too, the holding structure 102 comprises a plurality of reserved spaces 106, each of which is adapted to contain a precious item 200 (FIG. 4). The reserved spaces 106 can be physically separated from each other or only functionally separated; at all events, each reserved space 106 comprises retaining means (not shown) to keep the precious item to a predetermined position.

In use, the holding structure 102 is at least partly filled with valuables 200. Subsequently, the data transferring means 104 is connected to the processing unit 105 from which said means is powered, the electric supply being transferred to antenna 103.

It is to be noted that the data transferring means 104 can be any device capable of interface connection with a processing unit to transmit data and receive power supply.

Preferably, the data transferring means 104 consists of a connector USB. When antenna 103 is powered, it generates a respective electromagnetic field feeding the transponders associated with the precious items contained in the reserved spaces 106 of the holding structure 102.

The response of each transponder is then detected by antenna 103 that will send signal S11 to the data transferring means 104 and, therethrough, to the processing unit 105, that will store the contents of the holding structure 2.

At this point, the holding structure 102 is disconnected from the processing unit and, when connection takes place again, a comparison between the precious items initially present in the holding structure 2 and the precious items 200 present in the holding structure 102 at the moment is carried out.

In this way the possible unjustified absence of any precious item can be determined or it is possible to automatically perform calculations relating to the sale transactions carried out between the two readings of the contents of the holding structure 102; these calculations can be for example directed towards automatically generating invoices in the electronic format, so as to be able to go back to the true missing precious item.

The invention achieves the intended purposes.

In fact, the sure and unequivocal determination of the contents of the holding structure before transport of same and storage of this datum into the storing means, i.e. occurrence of the above described first event, ensures that during transport, any removal of precious items from the holding structure will be immediately detected on occurrence of the above described second event, i.e. when the holding structure reaches its destination and is inserted into the storage structure.

This ensures a perfect traceability of the precious items during transport of same.

In addition, the holding structure can be indifferently housed within different storage structures (chest of drawers, display cases and safes, for example) present in the same structure (a shop, for example). During these operations, the presence of the precious items in the holding structure is determined both at the moment the holding structure leaves a first storage structure (new first event) and at the moment it is inserted into a second storage structure (new second event). This enables a perfect traceability of the precious items also within the same structure (a shop, for example).

Again, the processing unit, since it receives continuous information on the contents of each holding structure of each storage structure, is able to determine the location of a specific precious item in a sure and accurate manner.

The invention obtains important advantages.

In fact, due to the apparatus of the invention, particular precious items are prevented from being kept in inappropriate storage structures.

In particular, since the exact location of each precious item is known (as said above), it is possible to prevent a particular precious item that must be kept in a safe (a first type of storage structure) from being erroneously kept in a display case (a second type of storage structure), for example.

Again, by removing a holding structure from a storage structure (first event) immediately before proposing its contents for sale to a customer and introducing the holding structure again into the storage structure (second event) immediately afterwards, it is possible to determine with the greatest accuracy whether during display of the precious items some of them have been removed in an illegal manner. This ensures an excellent anti-theft effect.

The invention claimed is:

1. An apparatus for containing and transporting precious items comprising:

at least one holding structure (2) adapted to contain at least one precious item (200);

at least one antenna (3) adapted to detect a presence of an electronic identification device (201) associated with said precious item (200) in order to determine contents of the holding structure (2) and send a signal (S1) representative of same precious item at least on occurrence of a predetermined event;

storing means (4) physically associated with said holding structure (2) and operatively associated with said antenna (3) for receiving the signal sent by said antenna (3) on occurrence of a first event and store the contents of said holding structure (2) on occurrence of said first event;

said first event being powering of said antenna (3);

a processing unit (5) to be connected to said storing means (4) and said antenna (3) in order to compare contents of the storing means (4) with a signal (S2) sent by said antenna (3) on occurrence of a second event subsequent in time to said first event;

said processing unit (5) being connectable to a plurality of storage structures (6);

said holding structure (2) being adapted to be transported and removably engaged in said plurality of storage structures (6);

said holding structure (2) being insertable in a removable manner into a storage structure (6), the latter comprising enable means (7) for sending said signal (S2) generated by said antenna (3), and reading the contents of the storage means (4);

said enable means (7) comprising an electric connection (8) for power supply to said antenna (3) so as to generate the electromagnetic field feeding said electronic identification device (201) associated with said precious item (200);

wherein said storage structures (6) are adapted to receive a plurality of said holding structures (2);

said second event being a full insertion of said holding structure (2) into the one of said plurality of storage structures (6) once said holding structure (2) has reached its destination.

2. An apparatus as claimed in claim 1, wherein said enable means (7) comprises a data transmitting device (11) for sending data to said processing unit (5).

3. An apparatus as claimed in claim 2, wherein said enable means (7) comprises a single data transmitting line (12) for sending the signals coming from each holding structure (2) to said data transmitting device (11).

4. An apparatus as claimed in claim 1, wherein said holding structure (2) comprises a plurality of reserved spaces (13) each of which is adapted to hold a precious item (200); each reserved space (13) being associated with a respective antenna (3).

5. An apparatus as claimed in claim 4, wherein each reserved space (13) is electromagnetically insulated from the others.

6. An apparatus as claimed in claim 4, wherein said storing means (4) consists of a single storing device adapted to store the signals sent, on occurrence of said first event, by the antenna (3) of each reserved space (13) of the holding structure (2).

7. An apparatus as claimed in claim 6, wherein said storing device is adapted to store the signal (S2) sent by said antennas (3) on occurrence of said second event, in order to store the contents of said holding structure (2) on occurrence of said second event.

8. An apparatus as claimed in claim 1, wherein said holding structure (2) is a drawer alternatively insertable into a plurality of storage structures (6).

9. An apparatus as claimed in claim 8, wherein said plurality of storage structures (6) is a homogeneous or heterogeneous combination of chests of drawers, safes, display tables, display cases.

10. An apparatus as claimed in claim 1, wherein said processing unit (5) is connectable to a plurality of storage structures (6), irrespective of the fact that they are equal to or different from each other.

* * * * *